US007563174B1

(12) United States Patent
Hung

(10) Patent No.: US 7,563,174 B1
(45) Date of Patent: Jul. 21, 2009

(54) CONNECTING STRUCTURE OF A SHAFT AND A GRIP MEMBER OF A GOLF CLUB

(75) Inventor: Chi-Chih Hung, Feng-Shan (TW)

(73) Assignee: Eing Nan Rubber Co., Ltd., Kaohsiung Hsien (TW)

( * ) Notice: Subject to any disclaimer, the term of this patent is extended or adjusted under 35 U.S.C. 154(b) by 38 days.

(21) Appl. No.: 12/007,399

(22) Filed: Jan. 10, 2008

(51) Int. Cl.
*A63B 53/14* (2006.01)

(52) U.S. Cl. ..... 473/300

(58) Field of Classification Search ..... 473/300–303, 473/549–552, 568, 298–299; D21/756; D8/DIG. 6, D8/DIG. 7, DIG. 8; 74/551.9; 81/489–490, 81/492; 16/421, 430, DIG. 12, DIG. 18, 16/DIG. 24; 280/821
See application file for complete search history.

(56) References Cited

U.S. PATENT DOCUMENTS 4,796,373 A * 1/1989 Struntz ..... 43/23
5,131,116 A * 7/1992 Bowdler ..... 16/427
5,299,802 A * 4/1994 Bouchet-Lassale ..... 473/206
6,921,340 B2 * 7/2005 Dickie ..... 473/220
2002/0077191 A1 * 6/2002 Roelke ..... 473/300
2003/0109326 A1 * 6/2003 Roelke ..... 473/300
2004/0198529 A1 * 10/2004 Moore ..... 473/296
2005/0009616 A1 * 1/2005 Dickie ..... 473/220
2007/0157758 A1 * 7/2007 Shih ..... 74/551.9
2007/0295150 A1 * 12/2007 Lai ..... 74/551.9
2008/0156139 A1 * 7/2008 Lai ..... 74/551.9

* cited by examiner

*Primary Examiner*—Stephen L. Blau
(74) *Attorney, Agent, or Firm*—Rosenberg, Klein & Lee

(57) ABSTRACT

A golf club includes a shaft, and a grip member secured around a tail portion of the shaft; a constricting and fastening component is secured in the grip member to fasten the shaft to the grip member; the constricting and fastening component includes a constricting ring around the shaft, and a driving rod, which can be operated so as to reduce the circumference of the constricting ring in order for the constricting ring to be tight around the shaft, thus preventing the shaft from turning relative to the grip member; the driving rod can be operated so as to expand the constricting ring in order for the ring to loosen the shaft, thus allowing the shaft to be separated from the grip member.

8 Claims, 5 Drawing Sheets

CONNECTING STRUCTURE OF A SHAFT AND A GRIP MEMBER OF A GOLF CLUB

BACKGROUND OF THE INVENTION

1. Field of the Invention

The present invention relates to a connecting structure of a shaft and a grip member of a golf club, more particularly one, which enables the shaft and the grip member to be firmly coupled together without the possibility of both turning relative to each other to change the flying direction of a golf ball when the golf club hits against the golf ball.

2. Brief Description of the Prior Art

A common golf club has a grip member secured around a tail portion of the shaft, which is easy to hold, and will absorb the shock against the golfer's hands when the golf club hits against a golf ball.

U.S. Pat. No. 6,626,768 teaches a golf club structure, wherein a grip member is directly placed around a shaft without any fastening means to prevent both from turning relative to each other. Therefore, it is possible for the shaft to turn relative to the grip member to reduce the accuracy of the flying direction of a golf ball when the golf club hits against the golf ball.

U.S. Pat. No. 6,988,958 taught another golf club structure, wherein a metallic ring is buried in a grip member, and the grip member is positioned around and fastened to a shaft with a bolt being passed through a hole of the grip member and a hole of the metallic, and tightly pressed against the shaft to prevent the shaft from turning relative to the grip member. However, because both and the shaft and the bolt are made of metallic materials, and the tail end of the bolt and the shaft have a smooth surface, it is still possible for the shaft to turn relative to the grip member when the golf club hits against a golf ball.

SUMMARY OF THE INVENTION

It is a main object of the present invention to provide an improvement on a connecting structure of a shaft and a grip member of a golf club, which will prevent the shaft from turning relative to the grip member to reduce the accuracy of the flying direction of a golf ball when the golf club hits against the golf ball.

A golf club according to an embodiment of the present invention includes a shaft, and a grip member around a tail portion of the shaft; a constricting and fastening component is securely disposed in the grip member to fasten the shaft to the grip member; the constricting and fastening component includes a constricting ring around the shaft, and a driving rod, which can be operated so as to reduce the circumference of the constricting ring in order for the constricting ring to be tight around the shaft, thus fastening the shaft to the grip member; the driving rod can be operated so as to expand the constricting ring in order for the ring to loosen the shaft, thus allowing the shaft to be separated from the grip member and replaced with a new one.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
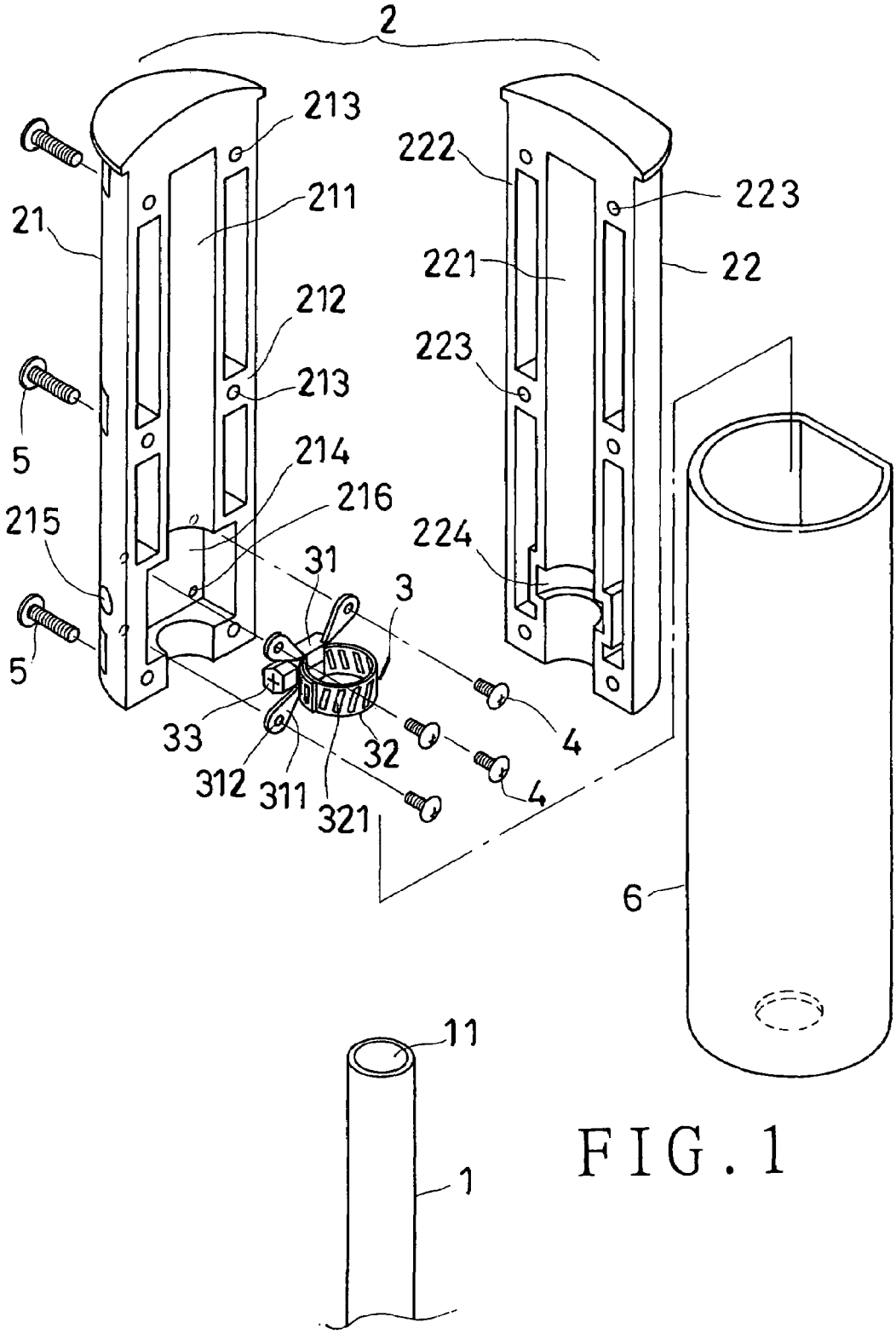
FIG. 1 is an exploded perspective view of the present invention.
Figure 2:
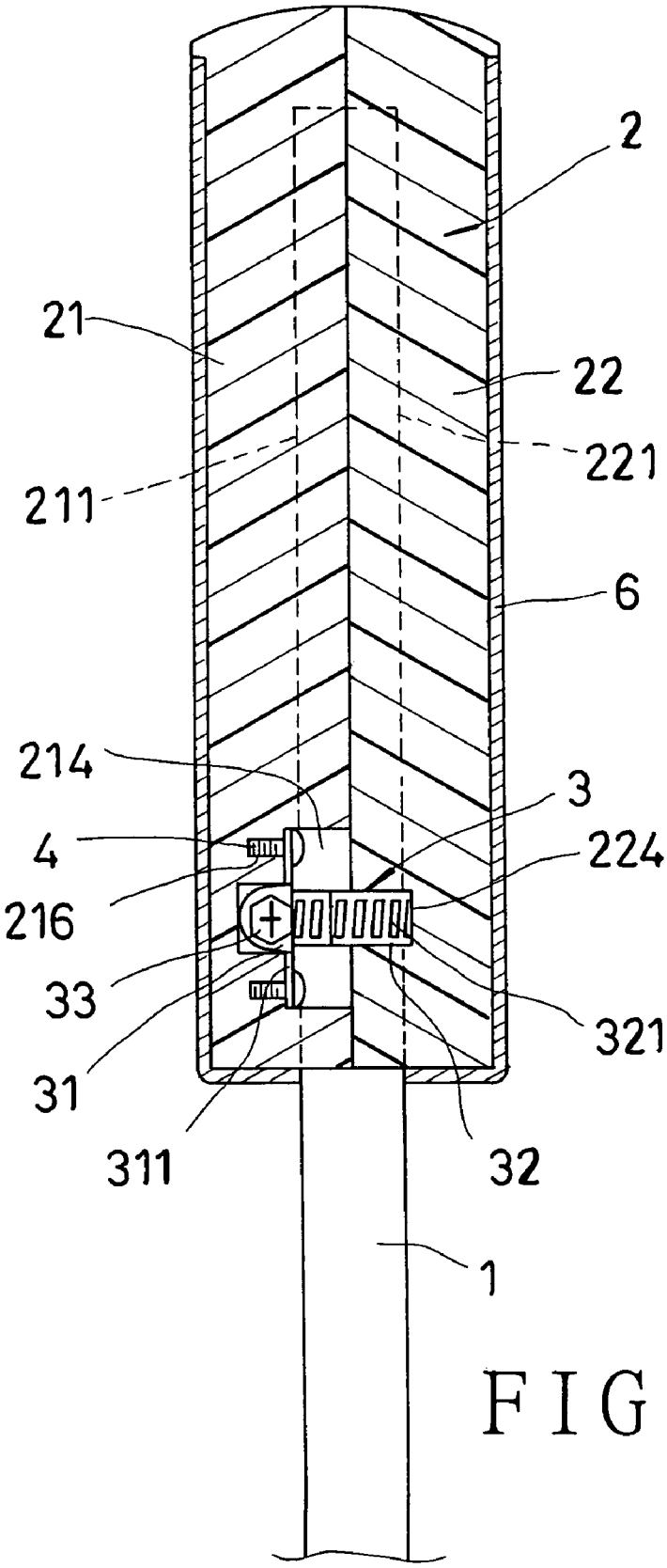
FIG. 2 is a first sectional view of the present invention.
Figure 3:
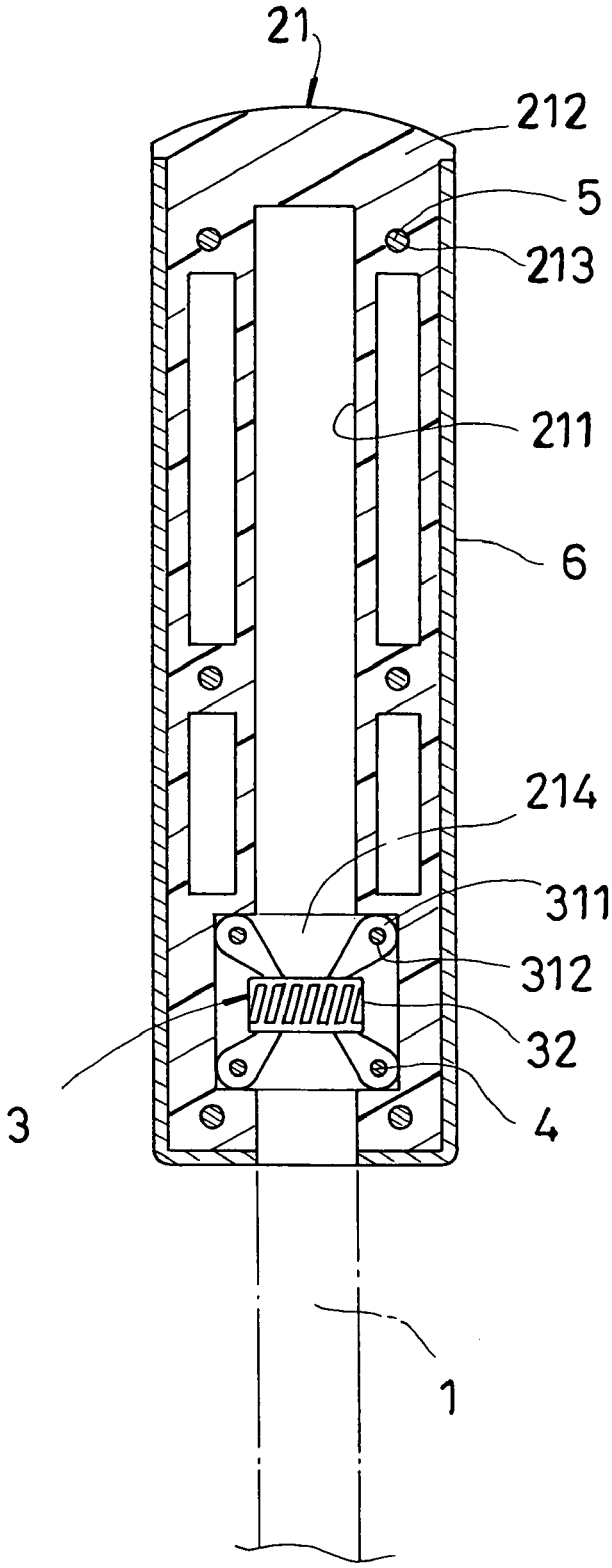
FIG. 3 is a second sectional view of the present invention.
Figure 4:
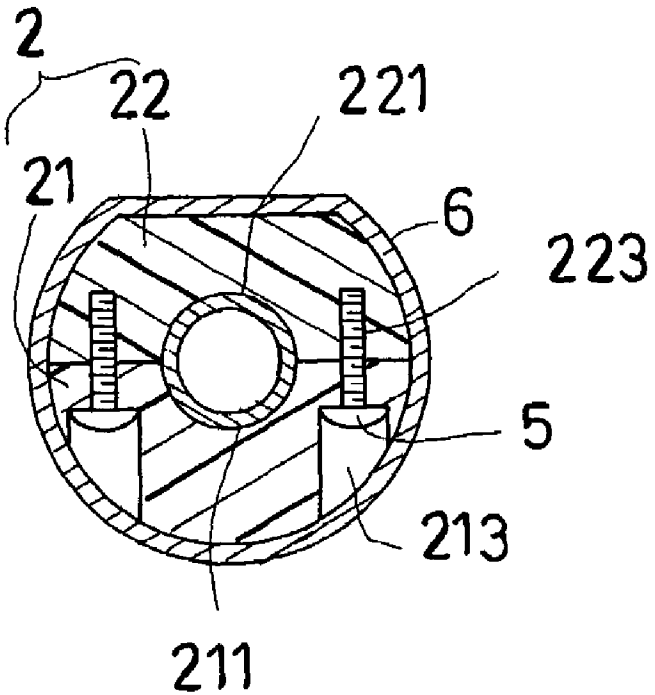
FIG. 4 is a third sectional view of the present invention.
Figure 5:
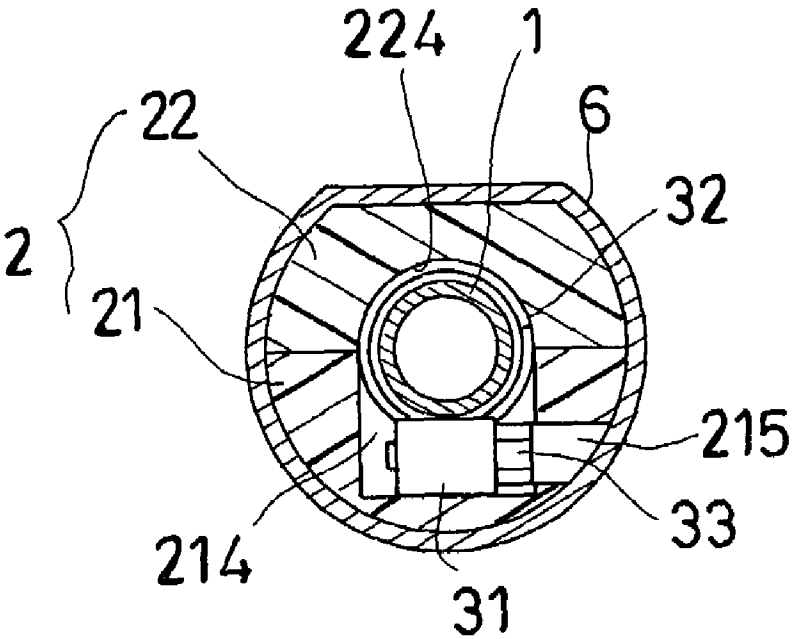
FIG. 5 is a fourth sectional view of the present invention.
Figure 6:
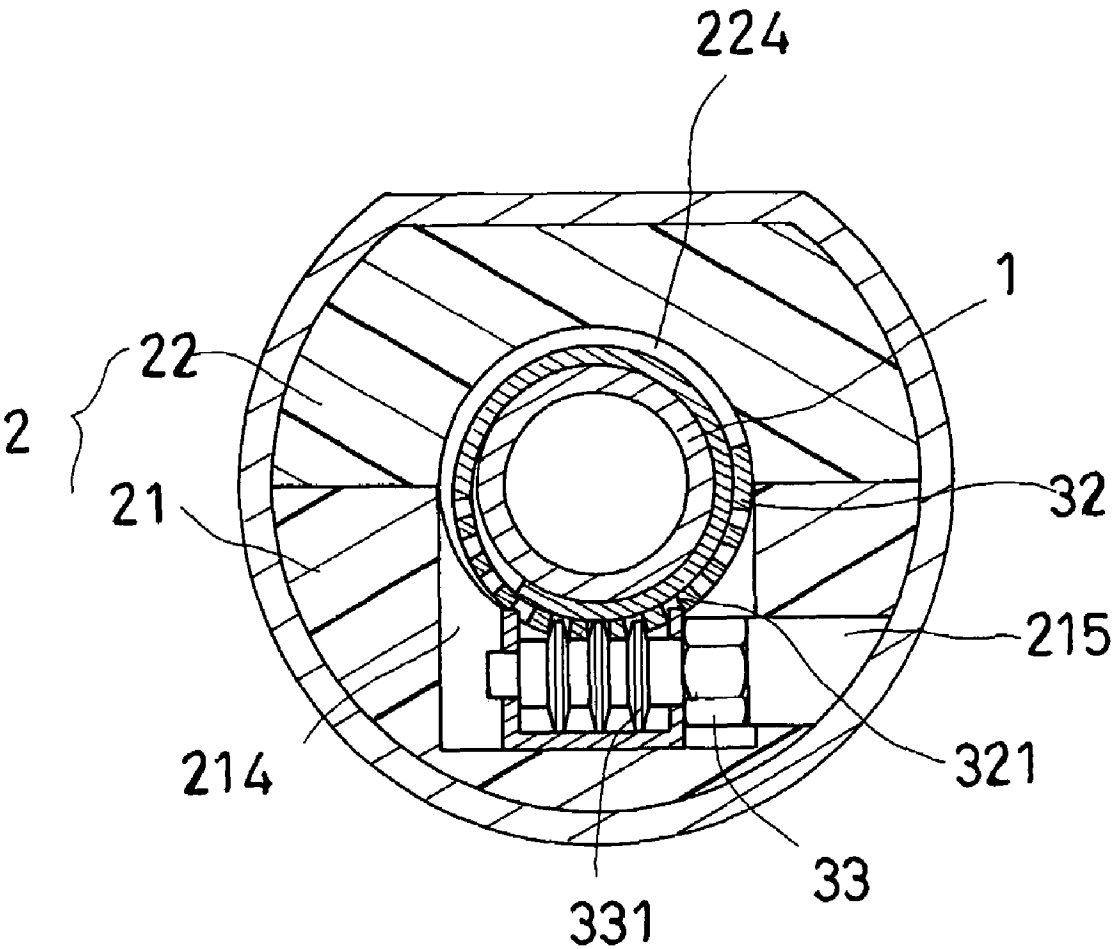
FIG. 6 is an enlarged sectional view of the present invention.

Referring to FIG. 1, a preferred embodiment of a golf club of the present invention includes a shaft 1, a grip member 2, and a constricting and fastening component 3.

The shaft 1 has an opening 11 on a tail portion thereof. The grip member 2 has a holding room therein, which has an opening facing the shaft 1. The grip member 1 includes a first half shell part 21, and a second half shell part 22, which are positioned face to face, and securely joined together.

The first half shell part 21 has a lengthways extending room 211 on a middle portion thereof, and a solid portion 212, which is around the lengthways extending room 211, and has at least one first connecting hole 213 thereon; the first connecting hole 213 of the present preferred embodiment is a through hole. Furthermore, the first half shell part 21 has a recessed portion 214 on a lower section thereof, and a passage 215 extending from an outer side thereof to the recessed portion 214. The first half shell part 21 has at least one fixing hole 216 on the recessed portion 214; the fixing hole 216 of the present embodiment is a screw hole. The second half shell part 22 has a lengthways extending room 221 on a middle portion thereof, and a solid portion 222, which is around the lengthways extending room 221, and has at least one second connecting hole 223; the second connecting hole 223 of the present embodiment is a screw hole. Furthermore, the second half shell part 22 has a shallow recess 224 on a lower section thereof, which will be faced with the recessed portion 214 of the first half shell part 21 after both the half shell parts 21 and 22 are joined together.

The constricting and fastening component 3 is secured in the grip member 2, and includes a supporting base 31, a constricting ring 32, and a driving rod 33. The supporting base 31 is held in the recessed portion 214 of the grip member 2; the supporting base 31 has at least one extension plate 311 protruding from a periphery thereof, which has a through hole 312; the supporting base 31 is securely joined to the first half shell part 21 by means of a fastening element 4 passed through the through hole 312 of the extension plate 311 and into the fixing hole 216 of the first half shell part 21. The constricting ring 32 is joined to the supporting base 31, and received in the shallow recess 224 of the grip member 24; the constricting ring 32 has several equidistantly spaced slots 321 thereon, which are at the same oblique angle. The driving rod 33 is supported on the supporting base 31, and has screw threads 331 on an outer side; the thread pitch of the driving rod 33 is equal to the distance between two adjacent ones of the slots 321 of the constricting ring 32. The driving rod 33 is engaged with the slots 321 of the constricting ring 32 at the screw threads 331. Thus, the constricting ring 32 can be reduced in its circumference so as to fasten the shaft 1 by means of operating the driving rod 33, and it can be expanded so as to loosen the shaft 1 by means of operating the driving rod 33.

Referring to FIG. 2 to FIG. 6, in assembly, first the constricting and fastening component 3 is securely joined to the first half shell part 21 by means of the fastening element 4, with the supporting base 31 being held in the recessed portion 214. Next, the first and the second half shell parts 21 and 22 are secured together by means of a fixing element (bolt) 5 passed through the first connecting hole 213 of the first half shell part 21 and into the second connecting hole 223 of the second half shell part 22; thus, the lengthways extending rooms 211 and 221 together make up the holding room of the grip member 2, and the constricting ring 32 is joined on the shallow recess 224 of the second half shell part 22. At last, the shaft 1 is passed in the holding room of the grip member 2 and through the constricting ring 32 from the tail portion, and the driving rod 33 is operated to reduce the circumference of the constricting ring 32 so that the constricting ring 32 is tight around the shaft 1 so as to fasten the shaft 1 to the grip member 2; the driving rod 33 can be moved by means of a proper tool, which has to be passed through the passage 215 of the first half shell part 21 to reach the driving rod 33.

Therefore, the shaft 1 can be easily loosened by means of operating the driving rod 33 of the constricting and fastening component 3 so as to expand the constricting ring 32. And, the shaft 1 can be easily replaced with another one.

In addition, an ornamental member 6 is positioned around the grip member 2 to cover the first connecting hole 213 of the first half shell part 21 and the fixing element 5.

From the above description, it can be seen that the golf club of the present invention has the following advantages over the prior arts:

The constricting and fastening component is fixedly held in the grip member, and has the constricting ring, which can be forced to become smaller so as to be tight around the shaft by means of operating the driving rod. Therefore, the connection of the grip member to the shaft is relatively firm, and therefore can prevent the shaft from turning relative to the grip member when the golf club is hitting against a golf ball.

The constricting ring of the constricting and fastening component can be easily expanded to loosen the shaft by means of operating the driving rod. Therefore, the grip member can be replaced with a new one relatively easily.

What is claimed is:

1. A connecting structure of a shaft and a grip member of a golf club, comprising a shaft;

a grip member positioned around and fastened to a tail portion of the shaft, the grip member having a holding room, which has an opening facing the shaft; the grip member having a recessed portion on an inner side of a lower section thereof; the grip member having a passage extending from an outer side to the recessed portion; the grip member having a shallow recess on the inner side, which faces the recessed portion;

a constricting and fastening component joined on the recessed portion and the shallow recess of the grip member; the constricting and fastening component including a supporting base held in the recessed portion of the grip member; the constricting and fastening component including a constricting ring fitted on the supporting base to be tight around the shaft; the constricting and fastening component including a driving rod facing the passage of the grip member; the driving rod being capable of being turned so as to move the constricting ring between a reduced fastening position and an expanded loosening one.

2. The connecting structure of a shaft and a grip member of a golf club as claimed in claim 1, wherein the grip member includes a first half shell part, and a second half shell part, which are joined together to make up the grip member;

each of the half shell parts having a lengthways extending room on a middle portion thereof; the lengthways extending rooms together making up said holding room.

3. The connecting structure of a shaft and a grip member of a golf club as claimed in claim 2, wherein each of the first and the second half shell parts of the grip member has a solid portion;

the solid portion of the first half shell part having at least one first connecting hole; the solid portion of the second half shell part having at least one second connecting hole; the half shell parts being securely joined together by means of a fixing element passed into the first and the second connecting holes thereof.

4. The connecting structure of a shaft and a grip member of a golf club as claimed in claim 3, wherein the first connecting hole is a through hole, the second connecting hole a screw hole, and the fixing element is a bolt.

5. The connecting structure of a shaft and a grip member of a golf club as claimed in claim 2, wherein the recessed portion is formed on a lower section of the first half shell part, and the shallow recess is formed on a lower section of the second half shell part.

6. The connecting structure of a shaft and a grip member of a golf club as claimed in claim 5, wherein the recessed portion of the first half shell part has at least one fixing hole, and the supporting base of the constricting and fastening component has at least one extension plate thereon, which has a through hole; the constricting and fastening component being secured to the first half shell part by means of a fastening element passed through the through hole of the extension plate and into the fixing hole of the first half shell part.

7. The connecting structure of a shaft and a grip member of a golf club as claimed in claim 1, wherein the constricting ring of the constricting and fastening component has a plurality of equidistantly spaced slots thereon, and the driving rod has screw threads on an outer side thereof;

the driving rod being engaged with the slots of the constricting ring at the screw threads;

the slots being at a same oblique angle;

a thread pitch of the driving rod being equal to a distance between two adjacent ones of the slots of the constricting ring.

8. The connecting structure of a shaft and a grip member of a golf club as claimed in claim 1 further having a member positioned around the grip member.

* * * * *